US006250603B1

(12) United States Patent
Knowles et al.

(10) Patent No.: US 6,250,603 B1
(45) Date of Patent: Jun. 26, 2001

(54) ADJUSTABLE DEVICE FOR OPENING SERVICE VALVES

(75) Inventors: Steven M. Knowles, Silver Lake, IN (US); Terrance D. Kalley, Troy, MI (US)

(73) Assignee: Prime Solutions, LLC, Troy, MI (US)

( * ) Notice: Subject to any disclaimer, the term of this patent is extended or adjusted under 35 U.S.C. 154(b) by 0 days.

(21) Appl. No.: 09/448,610

(22) Filed: Nov. 24, 1999

(51) Int. Cl.[7] ..... F16K 51/00; F16K 47/00; F17D 65/72

(52) U.S. Cl. ..... 251/149.1; 251/149.2; 251/149.3; 251/149.6; 251/148; 251/121; 137/613

(58) Field of Search ..... 251/149.1, 149.2, 251/149.3, 149.4, 149.6, 149.7, 148, 121, 122; 137/613

(56) References Cited

U.S. PATENT DOCUMENTS 3,592,439 * 7/1971 Ritchie, Jr. ..... 251/149.6
4,017,057 * 4/1977 Strybel ..... 251/149.1
4,328,948 * 5/1982 Pearl, II ..... 251/149.6
5,139,049 * 8/1992 Jensen et al. ..... 137/164.05
5,244,010 9/1993 Barjasteh et al. ..... 137/614.05
5,293,902 * 3/1994 Lapierie ..... 137/614.04
5,370,359 12/1994 Sadegh et al. ..... 251/276
5,370,527 * 12/1994 Hefling et al. ..... 251/149.6
5,450,875 9/1995 Chichester et al. ..... 137/614.05
5,975,490 11/1999 Essman ..... 251/149.4

* cited by examiner

*Primary Examiner*—Joseph A. Kaufman
*Assistant Examiner*—David A. Bonderer
(74) *Attorney, Agent, or Firm*—Fish & Richardson P.C.

(57) ABSTRACT

A service port connector for connecting to a service port of a pressurized system is described. The connector includes a valve opening member for opening a valve within the port. The position of the valve opening member within the connector is adjustable. The adjustable valve opening member allows the valve in the service port to be opened fully by the connector over a range of valve positions within the port. The connector can attach to a service device for servicing the pressurized system. The system can be an air conditioning or refrigeration system.

21 Claims, 3 Drawing Sheets

ADJUSTABLE DEVICE FOR OPENING SERVICE VALVES

BACKGROUND OF THE INVENTION

The present invention relates an adjustable device for opening service valves of a pressurized system, in particular an air conditioning or refrigeration system.

Service devices, such as service couplings, are commonly employed to facilitate charging and evacuation of a pressurized fluid system, such as a refrigeration system, an air conditioning system, or a hydraulic system. The service device connects to a service port of the system. The service device opens a valve within the service port, allowing fluids, including liquids or gases, to be exchanged with the system. For example, when servicing a refrigeration or air conditioning system, the service device can be connected by a flexible hose to a refrigerant supply source, such as a pressurized bottle or cylinder. When the service device and valve within the service port are opened, refrigerant can flow through the connection and into the refrigeration or air conditioning system.

In order to properly open a valve within the service port, the valve must be positioned properly within the service port so that the service device can open the valve when connected to the port. Deviations in valve position within the port can cause the service device to improperly open the valve, fail to open the valve, or damage the valve by applying excessive pressure to the valve.

SUMMARY OF THE INVENTION

The invention features a service port connector for connecting to a service port of a pressurized system. The connector includes a valve opening member for opening a valve within the port. The position of the valve opening member within the connector is adjustable. The adjustable valve opening member allows the valve in the service port to be opened fully by the connector over a range of valve positions within the port, opening the valve properly regardless of the position of the valve in the port.

In one aspect, the invention features a service port connector. The connector includes a body and a valve opening member. The body has a first end engageable with a service port, the service port including a valve. The body also includes a second end engageable with a service device, and an inner surface defining an interior chamber. The first end and the second end are in fluid communication through the interior chamber. The valve opening member is disposed in the interior chamber.

The valve opening member includes a valve actuating end proximate to the first end. The valve actuating end is capable of changing position relative to the first end. The valve actuating end is configured to open the valve as the first end is engaged with the port. The valve opening member can be arranged to depress a pin within the valve when engaged with the port. The first end can be capable of forming a seal with the port when it is engaged with the port. The connector can include a sealing gasket between the body and the first end. The connector can include a threaded fitting or a snap-on fitting at the first end for engaging it with the port.

In certain embodiments, the valve opening member is engageable with a tool for changing the position of the valve actuating end relative to the first end. The valve opening member and the inner surface of the body can be threaded. The position of the valve opening member can be adjusted using a tool.

In other embodiments, the service port connector includes a spring between the valve opening member and the second end of the body. The valve opening member is biased by the spring toward the first end. The position of the valve opening member can be adjusted by pressing the valve of the port against the member to compress the spring. The spring can be less compressible than the valve or pin.

In other embodiments, the second end of the body is engaged with a service device and the valve opening member is in a fixed position relative to the service device. The second end can be movably engaged with the service device. Movement of the body relative to the service device can change the position of the valve actuating end relative to the first end. For example, the second end of the body can be connected to the device by threading, and the body or service device can be rotated to change the position of the valve actuating end. A button, a switch, a lever, a knob, or a rocker can be used to move the valve actuating end relative to the first end.

In another aspect, the invention features a method of opening a service port. The method includes adjusting a position of a valve actuating end of a valve opening member relative to a first end of a service port connector and opening a valve within the service port. The valve actuating end is capable of being positioned relative to the first end to open the valve as the first end is engaged with the port. The valve opening member being within the connector. The first end is engageable with the service port. The service port connector can be attached to a service device. When the connector is attached to a service device, the connector can be an integrated portion of the service device or it can be separable from the service device. Alternatively, the service port connector can be capable of attaching to a service device. In certain embodiments, the method includes sealing the connector to the port prior to or concurrently with opening the valve.

Adjusting can include changing the position of the valve actuating end relative to the first end with a tool or moving the valve opening member relative to the first end against a spring, the spring being biased to position the valve opening member toward the first end. Alternatively, the connector can include a second end engaged with a service device and the valve opening member can be in a fixed position relative to the service device. When the valve opening member can be in a fixed position relative to the service device, adjusting can include moving the second end relative to the service device to change the position of the valve actuating end relative to the first end. Since the movement is relative, either the body or the service device can be moved to change the position of the valve actuating end relative to the first end.

Additional features and advantages of the invention will become apparent from the detailed description of the invention.

DETAILED DESCRIPTION OF THE PREFERRED EMBODIMENT

Figure 1:
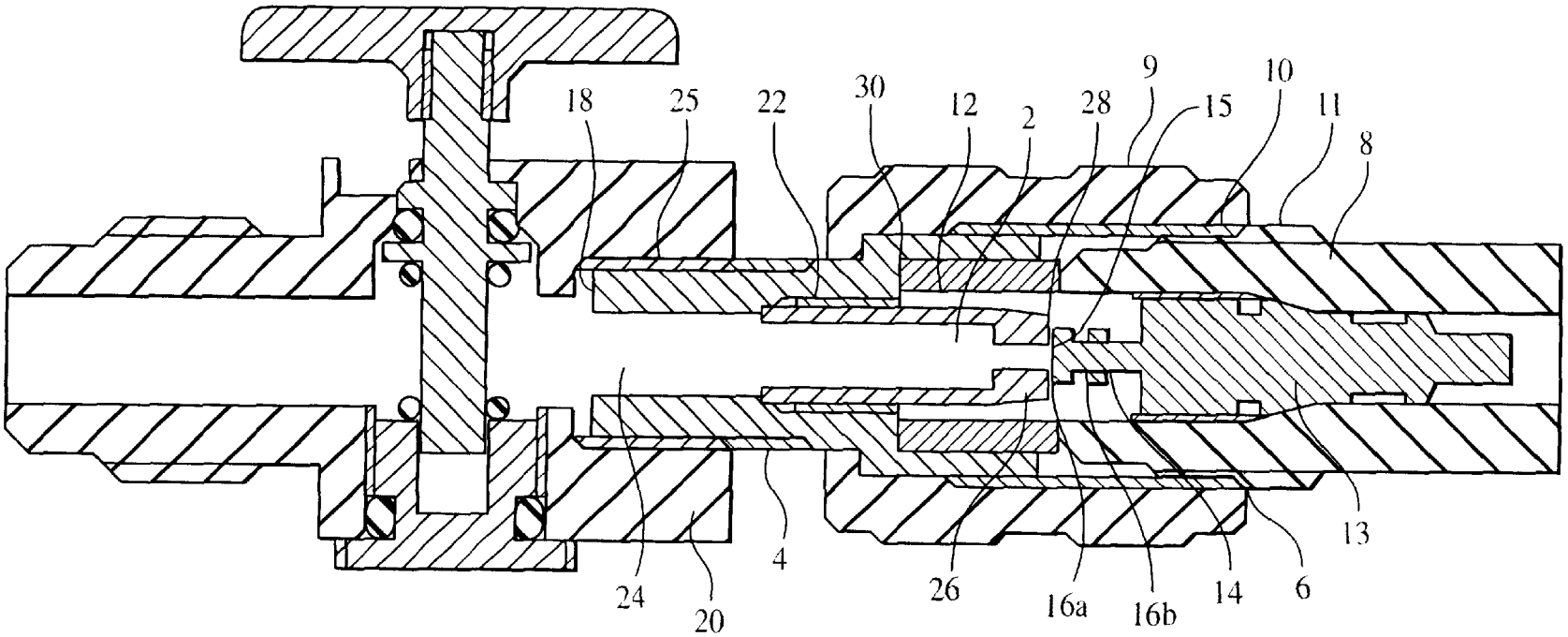
FIG. 1 is a schematic drawing depicting a sectional view of a connector that is adjustable with a tool.
Figure 2:
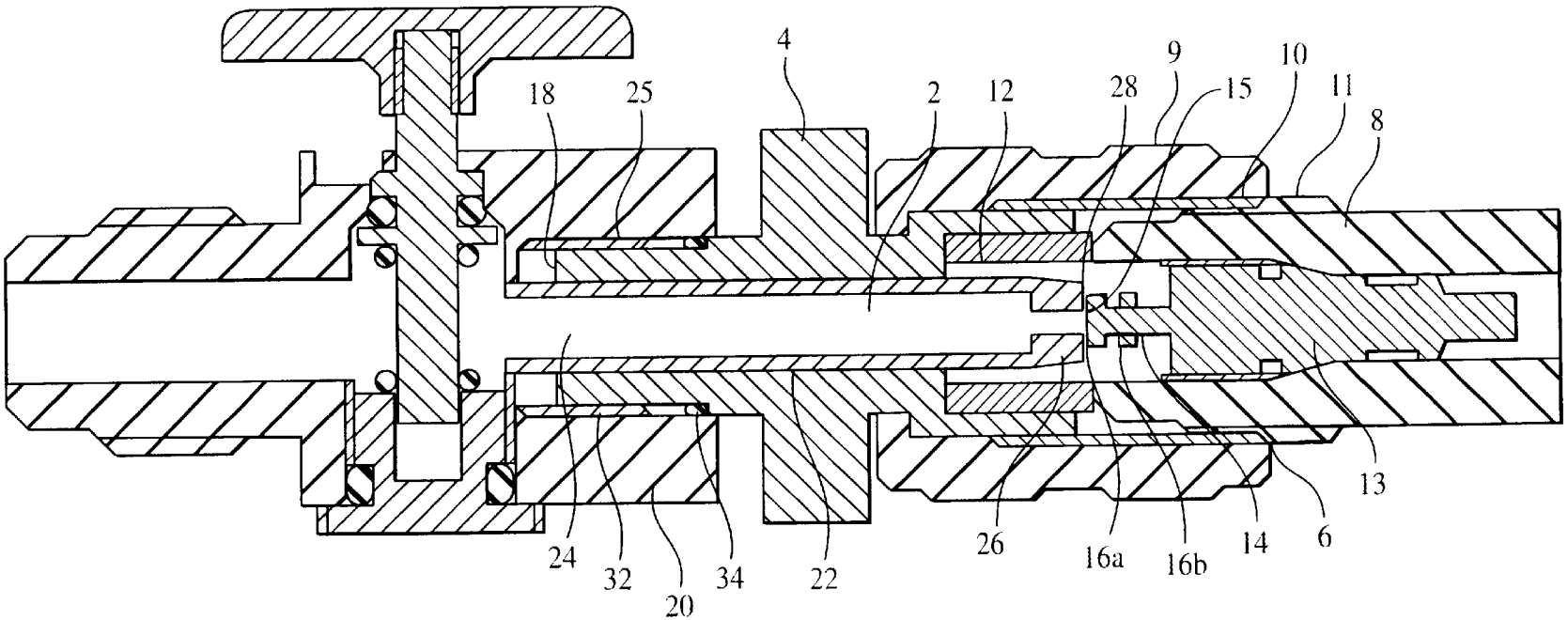
FIG. 2 is a schematic drawing depicting a sectional view of a connector that is manually adjustable without a tool.
Figure 3:
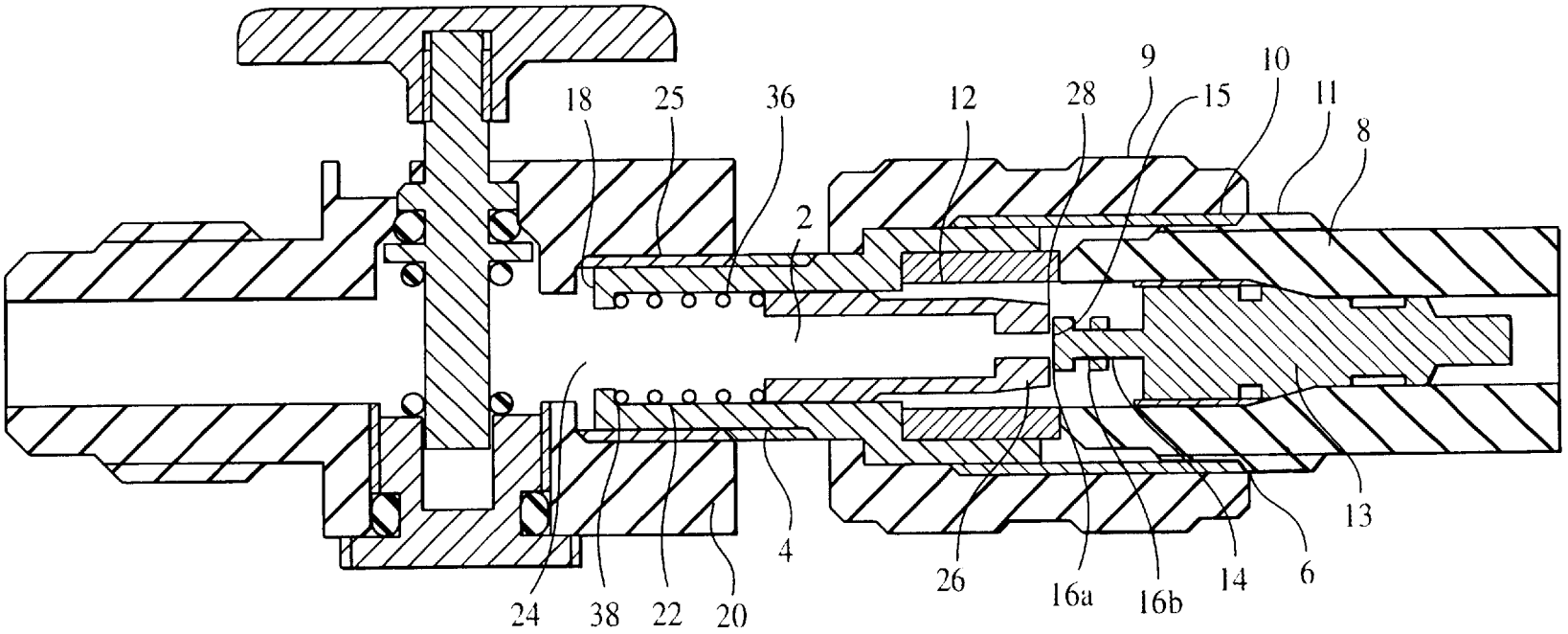
FIG. 3 is a schematic drawing depicting an exploded view of a connector that is adjustable automatically.

Referring to FIGS. 1–3, service port connector 2 includes body 4. Body 4 has first end 6 engageable with service port 8. Swivel nut 9 connects body 4 to port 8 via threaded surface 10 which mates with threads 11 on the outer surface of port 8. Alternatively, the body can connect to the port by a snap-on fitting, in which a release sleeve snaps onto the port to engage the connector with the port. The balls are engageable with the first valve. Connector 2 also includes sealing gasket 12, which forms a gas-tight seal with port 8 as end 6 is engaged with port 8. Because the system typically contains pressurized fluids, the connector can form a seal with the port prior to opening the valve. Service port 8 can be a high pressure-side refrigerant port or low pressure-side refrigerant port, such as a male R12 port (as shown). As an alternative to the R12 port, the port can be a R134a port, a 14 mm port, a ¼ inch flare port, a ⅜ inch flare port, or a ⅜ inch ACME port, or other fitting typically used in air conditioning or refrigeration systems. The connector can be adapted to mate with Society of Automotive Engineers (SAE)-dimensioned ports and can be constructed from metal, such as, for example, brass, steel, stainless steel, or aluminum, for durability.

Service port 8 includes valve 13, which can be a Schrader-type valve (as shown). Valve 13 contains pin 14 which when actuated by pressing into the valve opens the valve. The position of valve 13 within port 8 can vary. As a result, the position of end 15 of pin 14 can vary between minimum position 16*a* and maximum position 16*b*. The variation in pin end position between position 16*a* and 16*b* can be outside the tolerances suggested by the SAE or the American Refrigeration Institute (ARI). The variation in pin end position can be up to 50 thousandths of an inch outside the specified tolerances, more typically up to 40 thousandths of an inch outside the specified tolerances. For example, for a R12 port, the variation in pin end position between position 16*a* and 16*b* can be 50 to 60 thousandths of an inch, which is outside the SAE specifications. The valve position within other ports can vary by different amounts, as described the specified tolerances. The adjustable valve actuating end within the connector allows ports containing valves outside the specified tolerances, as well as those within the specified tolerances, to be opened by the connector.

Body 4 has second end 18 which engages with service device 20. Body 4 also has inner surface 22 which defines interior chamber 24, through which first end 6 and the second end 18 are in fluid communication. Outer body surface 25 connects to service device 20 via threaded surfaces. Alternatively, outer body surface 25 can be connected to service device 20 by pins, set screws, a snap ring, brazing, or soldering or body 4 can be an integral part of service device 20. Service device 20 can be an air conditioning or refrigeration service device, such as the purge device shown in FIGS. 1–3, or a service manifold, a coupling member, a valve core removal tool, a refrigerant cylinder, a fluid charge line, such as a hose, an anti-blow back valve, a refrigerant identifier or analyzer, a diagnosis instrument, a dye injector, a recovery and recycle station, or other device that can connect to a service port of a system.

Valve opening member 26 is disposed in interior chamber 24. Valve opening member 26 has valve actuating end 28. Valve actuating end 28 is located proximate to first end 6 and is capable of changing position relative to first end 6. As port 8 is inserted into first end 6, a seal is formed between port 8 and sealing gasket 12. Valve actuating end 28 contacts end 15 of pin 14, depressing it and opening valve 13. When attachment of connector 2 to port 8 is complete, pin 14 is completely depressed so that valve 13 is fully opened.

As noted above, the position of valve 13 within port 8 can vary such that the position of end 15 with respect to the port can vary up to 50 thousandths of an inch out of specified tolerances. If the valve is positioned so that end 15 is at position 16*a* the valve may be opened prematurely, and if the valve is positioned so that end 15 is at position 16*b* the valve may not be opened. The position of valve opening member 26, and valve actuating end 28, relative to first end 6 is adjustable. Adjustment of the position can allow the user to open the valve properly when the connector is attached to the port. In addition, this adjustment can help reduce or avoid potential damage to the valve by applying excessive pressure to the valve, help reduce or avoid leakage of fluid from the connector due to incomplete sealing before opening the valve, or help reduce or avoid decreased fluid flow from incomplete opening of the valve.

Referring to FIG. 1, inner surface 22 of body 4 and outer surface 30 of valve opening member 26 are threaded. The position of valve opening member 26 within body 4 can be adjusted by rotating valve opening member 26 along the threads. The threads not only hold valve opening member 26 within the body, they allow the position of the member to vary. The position can vary by up to 50 thousandths of an inch. This allows the position of member 26, and valve actuating end 28, to be adjusted so that valve 13 of port 8 can be opened properly. The member position can be adjusted by changing the position of valve actuating end 28 relative to first end 6 using a tool. For example, valve actuating end 28 can be shaped to interface with a valve core removal tool, such as part 10987 available from Robinair, Montpelier, Ohio, which can be inserted into end 6 and twisted to change the member position.

The connector can be configured to adjust the position of valve opening member 26 relative to first end 6 using an adjustable body. Referring to FIG. 2, connector 2 is attached to service device 20 via second end 18. Device 20 and second end 18 are movably engaged by threads on outer body surface 25 and inner device surface 32. O-ring 34 forms a gas-tight seal between body 4 and device 20. Valve opening member 26 is fixed in position within device 20. Movement of body 4 relative to service device 20, by rotating along the threads changes the position of valve actuating end 28 relative to first end 6, allowing valve 13 to be opened properly when port 8 is attached to connector 2. The configuration of FIG. 2 allows the member position to be adjusted while port 8 is attached to connector 2.

In a third configuration, the position of valve opening member 26 adjusts automatically within body 4. Referring to FIG. 3, spring 36 is positioned between valve opening member 26 and lip 38 of body 4. Spring 36 allows the position of valve actuating end 28 relative to first end 6 to float, and biases member 26 toward first end 6. Floating allows the position of valve opening member 26 to be maintained when contacting pin end 15 as port 8 is inserted into first end 6, thereby opening valve 13. Accordingly, spring 36 is less compressible than pin 14. When valve 13 is completely open, spring 36 compresses, allowing member 26 to retract into body 4 and permitting a better seal to form between connector 2 and port 8. When port 8 is not engaged with first end 6, valve actuation end 28 is positioned relative to first end 6 so that it contacts pin end 15 in position 16*a* when port 8 first seals against seal 12.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A service port connector comprising:

a body having a first end engageable with a service port, a second end engageable with a service device, and an inner surface defining an interior chamber, the first end and the second end being in fluid communication through the interior chamber and the service port including a valve;

a valve opening member disposed in the interior chamber, the valve opening member including a valve actuating end proximate to the first end, the valve actuating end being capable of changing position relative to the first end, and the valve actuating end being positioned relative to the first end to open the valve as the first end is engaged with the port; and a sealing gasket having an inside diameter, the sealing gasket being disposed between the body and the first end, the first end being capable of forming a seal with the port when the first end is engaged with the port, wherein the valve opening member engages the interior surface of the body and has an outer diameter proximal to and smaller than the inside diameter of the sealing gasket, and the valve opening member is engageable with a tool for changing the position of the valve actuating end relative to the first end.

2. The service port connector of claim 1, wherein the valve opening member and the inner surface of the body are threaded.

3. The service port connector of claim 1, wherein the first end includes a threaded fitting for engaging the first end with the port.

4. The service port connector of claim 1, wherein the first end includes a snap-on fitting for engaging the first end with the port.

5. The service port connector of claim 1, wherein the valve opening member is arranged to depress a pin within the valve when engaged with the port.

6. A service port connector comprising:

a body having a first end engageable with a service port, a second end engageable with a service device, and an inner surface defining an interior chamber, the first end and the second end being in fluid communication through the interior chamber and the service port including a valve; and a valve opening member disposed in the interior chamber, the valve opening member including a valve actuating end proximate to the first end, the valve actuating end being capable of changing position relative to the first end, and the valve actuating end being positioned relative to the first end to open the valve as the first end is engaged with the port, wherein the second end is engaged with the service device and the valve opening member is in a fixed position relative to the service device.

7. The service port connector of claim 6, wherein the second end is movably engaged with the service device, the movement of the body relative to the service device changing the position of the valve actuating end relative to the first end.

8. The service port connector of claim 6, wherein the service port connector further comprises a button, switch, lever, knob, or rocker adapted to position the valve actuating end relative to the first end.

9. The service port connector of claim 6, further comprising a sealing gasket between the body and the first end, the first end being capable of forming a seal with the port when the first end is engaged with the port.

10. An air conditioning or refrigeration service device comprising:

a first end engageable with a service port including a valve and an inner surface defining an interior chamber;

a valve opening member disposed in the interior chamber, the valve opening member including a valve actuating end proximate to the first end, the valve actuating end being capable of changing position relative to the first end, and the valve opening member being engageable with a tool for changing the position of the valve actuating end relative to the first end; and a sealing gasket having an inside diameter, the sealing gasket being disposed between the body and the first end, the first end being capable of forming a seal with the port when the first end is engaged with the port, wherein the valve opening member engages the interior surface of the body and has an outer diameter proximal to and smaller than the inside diameter of the sealing gasket, and the valve opening member is engageable with a tool for changing the position of the valve actuating end relative to the first end.

11. The service device of claim 10, wherein the valve opening member and the inner surface of the body are threaded.

12. The service device of claim 10, wherein the first end includes a threaded fitting for engaging the first end with the port.

13. The service device of claim 10, wherein the first end includes a snap-on fitting for engaging the first end with the port.

14. A method of opening a service port comprising:

adjusting a position of a valve actuating end of a valve opening member relative to a first end of a service port connector, the valve opening member being within the connector and the service port connector being attached to a service device or being capable of attaching to a service device and the first end being engageable with the service port, wherein the service port connector includes a sealing gasket having an inside diameter, the valve opening member engages an interior surface of the connector and has an outer diameter proximal to and smaller than the inside diameter of the sealing gasket, the valve opening member is engageable with a tool for changing the position of the valve actuating end relative to the first end, and adjusting the position includes changing the position of the valve actuating end relative to the first end with a tool; and opening a valve within the service port, wherein the valve actuating end is capable of being positioned relative to the first end to open the valve as the first end is engaged with the port.

15. The method of claim 14, further comprising sealing the connector to the port prior to or concurrently with opening the valve.

16. An air conditioning or refrigeration service device comprising:

a first end engageable with a service port including a valve;

a valve opening member disposed within the service device, the valve opening member being in a fixed position relative to the service device, the valve opening member including a valve actuating end proximate to the first end, and the valve actuating end being capable of changing position relative to the first end; and a body movably engaged with the service device, the movement of the body relative to the service device changing the position of the valve actuating end relative to the first end.

17. The service device of claim 16, further comprising a sealing gasket between the body and the first end, the first end being capable of forming a seal with the port when the first end is engaged with the port.

18. The service device of claim 16, wherein the first end includes a threaded fitting for engaging the first end with the port.

19. The service device of claim 16, wherein the first end includes a snap-on fitting for engaging the first end with the port.

20. A method of opening a service port comprising:

adjusting a position of a valve actuating end of a valve opening member relative to a first end of a service port connector, the valve opening member being within the connector and the service port connector being attached to a service device or being capable of attaching to a service device and the first end being engageable with the service port; and opening a valve within the service port, wherein the valve actuating end is capable of being positioned relative to the first end to open the valve as the first end is engaged with the port and the connector includes a second end engaged with a service device and the valve opening member is in a fixed position relative to the service device.

21. The method of claim 20, wherein adjusting includes moving the second end relative to the service device to change the position of the valve actuating end relative to the first end.

* * * * *

UNITED STATES PATENT AND TRADEMARK OFFICE

CERTIFICATE OF CORRECTION

PATENT NO. : 6,250,603 B1
DATED : June 26, 2001
INVENTOR(S) : Steven M. Knowles et al.

It is certified that error appears in the above-identified patent and that said Letters Patent is hereby corrected as shown below:

Title page,
Item [75], Inventors, replace "Steven M. Knowles, Silver Lake, IN (US); Terrance D. Kalley, Troy, MI (US)" with -- [75] Inventors, Steven M. Knowles, Silver Lake, IN (US); Terrence D. Kalley, Troy, MI (US) --.

Signed and Sealed this

Fifteenth Day of January, 2002

*Attest:*

*Attesting Officer*

JAMES E. ROGAN
*Director of the United States Patent and Trademark Office*